US008517724B2

(12) United States Patent
Faslivi et al.

(10) Patent No.: US 8,517,724 B2
(45) Date of Patent: Aug. 27, 2013

(54) PROCESS AND REACTOR FOR REMOVING THE VOLATILE COMPONENTS OF THE FINE FRACTION COMING FROM THE CRUSHING OF VEHICLES AND IRON-CONTAINING SCRAPS

(75) Inventors: Giuseppe Faslivi, Rome (IT); Medardo Pinti, Rome (IT); Fabio Salvati, Rome (IT); Leopoldo Del Prete, Cisterna di Latina (IT)

(73) Assignees: Centro Sviluppo Materiali S.p.A., Rome (IT); Centro Rottami S.r.l., Cisterna di Latina, LT (IT)

( * ) Notice: Subject to any disclaimer, the term of this patent is extended or adjusted under 35 U.S.C. 154(b) by 562 days.

(21) Appl. No.: 12/599,453

(22) PCT Filed: May 9, 2008

(86) PCT No.: PCT/IB2008/051864

§ 371 (c)(1),
(2), (4) Date: Oct. 25, 2010

(87) PCT Pub. No.: WO2008/139408

PCT Pub. Date: Nov. 20, 2008

(65) Prior Publication Data

US 2011/0036270 A1 Feb. 17, 2011

(30) Foreign Application Priority Data

May 9, 2007 (IT) ..... RM2007A0270

(51) Int. Cl.
*F27B 7/20* (2006.01)

(52) U.S. Cl.
USPC ..... 432/117; 432/106; 432/110

(58) Field of Classification Search
USPC ..... 432/106, 109, 110, 113, 114, 117, 432/118
See application file for complete search history.

(56) References Cited

U.S. PATENT DOCUMENTS

| | | | | | |
|---|---|---|---|---|---|
| 3,199,851 | A | * | 8/1965 | Prigotsky | 432/92 |
| 3,295,930 | A | * | 1/1967 | Swanson et al. | 422/200 |
| 4,052,151 | A | * | 10/1977 | Reichrt et al. | 432/115 |
| 4,834,648 | A | * | 5/1989 | Angelo, II | 432/103 |
| 5,005,493 | A | | 4/1991 | Gitman | |
| 5,217,578 | A | * | 6/1993 | Taciuk et al. | 202/100 |
| 5,771,820 | A | | 6/1998 | Ruegg | |
| 5,944,960 | A | * | 8/1999 | Nakata et al. | 202/100 |

FOREIGN PATENT DOCUMENTS

| | | | |
|---|---|---|---|
| DE | 3520819 | A1 | 12/1986 |
| DE | 4104929 | A1 | 8/1992 |
| EP | 1612482 | A | 1/2006 |
| FR | 782674 | A | 6/1935 |

* cited by examiner

*Primary Examiner* — Gregory A Wilson
(74) *Attorney, Agent, or Firm* — Lucas & Mercanti, LLP

(57) ABSTRACT

A simple and economical process for rendering the fine fraction, from crushing of vehicles and iron scraps, capable of being used in the manufacture of bituminous or cement-based conglomerates as partial substitutes of quarry inerts.

Subject of the invention is also a reactor suitable for carrying out the above process.

Figure 1:
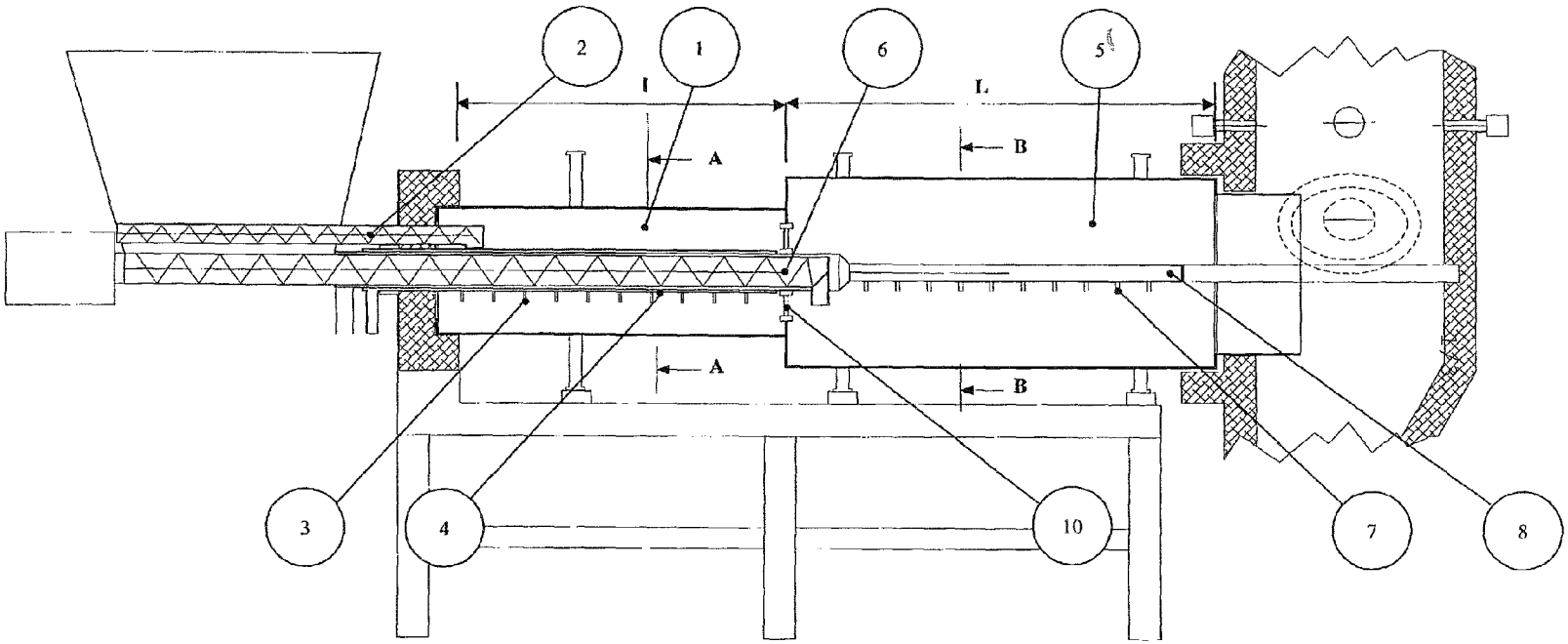

FIG. 1 shows an embodiment of the reactor.

12 Claims, 3 Drawing Sheets

PROCESS AND REACTOR FOR REMOVING THE VOLATILE COMPONENTS OF THE FINE FRACTION COMING FROM THE CRUSHING OF VEHICLES AND IRON-CONTAINING SCRAPS

The invention refers to the field of waste disposal; in particular, it refers to the valorization of the fine fraction coming from the separation of the residue from the crushing of vehicles and iron-containing scraps in general (the so-called FLUFF), as produced according to the process described in LT04A000006.

The present invention remarkably contributes to the solution of the problem of fine fraction of FLUFF recovery from "end-of-life vehicles".

As it is known, the fine fraction of available FLUFF, both as to composition and grain size, would be capable of being used as component in the manufacture process of bituminous or cement-based conglomerates as partial substitutes of quarry inerts.

However, this use is compromised by the fact that from said fine fraction foul odours are released in the course of the unavoidable subsequent hot treatment steps, like in asphalt preparation and in the road resurfacing stage.

In RM2004A000324 a single-chamber rotary drum apparatus is described.

However, this apparatus is not capable of removing the volatile components of the fine fraction at issue without a continuous contribution of fuel. Moreover, fine fraction particles cause the drawback of occluding the nozzles, which in RM2004A000324 lie at the mantle of the single chamber.

Hence, in the specific field there is a demand for a simple and economical technology for removing the volatile components of the fine fraction, thereby obtaining a thermally stable product, hence not susceptible of releasing the foul odours that prejudice its use.

This demand is met by the present invention, with the attainment of further advantages that will be made evident hereinafter.

In fact, subject of the present invention is a process for removing the volatile components of the fine fraction coming from the separation of the residue from the crushing of vehicles and iron-containing scraps, comprising the following steps, carried out in a rotary-drum reactor having two cylindrical chambers with overlapping bases, initially preheated at temperatures comprised in the range of 500-800° C and 400-600° C, respectively:

- feeding said fine fraction into the first chamber;
- injecting and distributing into the first chamber a combustion supporter (comburent), by at least two radial nozzles arranged on a pipe coaxial to the first chamber, with partial combustion of the fine fraction, consequent partial removal of the volatile substances present therein and holding of the temperature of 500-800° C;
- transferring the hot fine fraction, partially stripped of the volatile substances present therein, from the first to the second chamber by a duct with a progressively decreasing cross-section, to foster the attainment in the first chamber of the stay times needed for partial volatilization;
- feeding into the second chamber other fine fraction, which mixes to that already treated in the first chamber;
- injecting and distributing into the second chamber other combustion supporter, by at least two nozzles arranged onto a pipe coaxial thereto, with total removal of the volatile substances present in the fine fraction to be treated and holding of the temperature of 400-600° C;
- collecting the fine fraction free from the volatile components originally contained therein.

The process according to the invention can envisage that the second cylindrical chamber may be greater than the first one, both in length and diameter.

The two chambers making up the reactor are preferably coaxial therebetween; it is also possible, for reasons of high productivity, to set up a system having two reactors working in parallel.

One of the most important advantages of the process according to the invention is that, in spite of the low calorific value of the initial fine fraction, no contribution of other heating source is needed, apart during the transient phase for its attainment of a steady condition.

In fact, the low calorific value of the fine fraction, constituted for about the 70% of inorganic compounds (ash), would not allow to carry out with a single chamber, such as that proposed in RM2004A000324, a thermal process of volatilization without the use of additional fuel.

Another advantage is that the fine particles to be treated do not occlude the nozzles obtained into the pipes coaxial to the individual chambers (as instead occurred for the nozzles present at the mantle of the single-chamber apparatus of RM2004A000324).

The present invention also encompasses a reactor suitable for carrying out the process according to the invention.

In fact, subject of the present invention is also a reactor suitable for removing the volatile components of the fine fraction coming from the residue from the crushing of vehicles and iron-containing scraps, comprising the following parts:

- a first chamber (1) substantially cylindrical and rotating about its own axis, containing a burner thereinside and equipped with means (2) for feeding the fine fraction and means (3) for injecting the combustion supporter from a pipe (4) coaxial thereto;
- a second chamber (5), substantially cylindrical and rotating about its own axis, equipped with means (6) for feeding the fine fraction and means (7) for injecting the combustion supporter from a pipe (8) coaxial thereto;
- the first chamber and the second chamber being equipped with means (9) for mixing the fine fraction and the combustion supporter, and being connected therebetween by a duct (10), optionally frustoconical-shaped with a progressively decreasing cross section.

The second chamber (5) may be greater than the first chamber (1) both in length (L>1) and diameter (D>d).

In this case, the first chamber (1) and the second chamber (5) may be coaxial therebetween, or their axes may be parallel.

The means (2) and (6) for feeding the fine fraction respectively to the first chamber (1) and to the second chamber (5), may consist in an auger.

The means (3) and (7) for injecting the combustion supporter respectively into the first chamber (1) and into the second chamber (5) may consist in nozzles obtained into the coaxial pipes (4) and (8).

These nozzles, at least partly, both in the first and the second chamber may be oriented with respect to the horizontal axis of an angle comprised between 30° and 150°.

The means (9) for mixing the fine fraction and the combustion supporter, respectively in the first chamber (1) and in the second chamber (5) may consist in vanes located inside of the two chambers.

So far, a general description of the present invention was given. With the aid of the figures and examples, hereinafter a description of its embodiments will be provided, aimed at making better understood the objects, features, advantages and operation steps thereof.

FIG. 1 is a longitudinal section of an embodiment of the reactor according to the invention.

Figure 2:
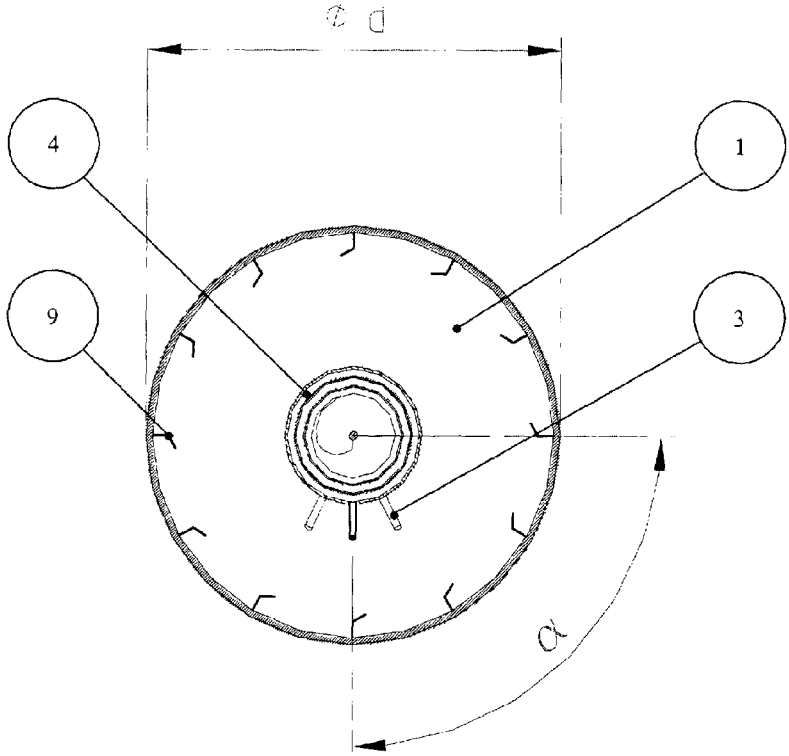
Figure 3:
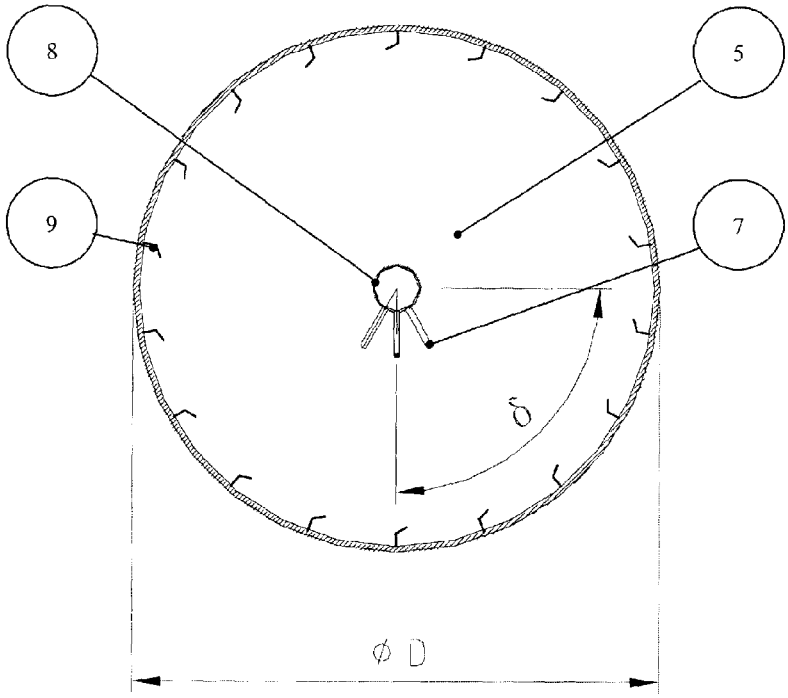

FIGS. 2 and 3 respectively depict sections A-A and B-B of the reactor of FIG. 1, with some of the nozzles distributing air into the first and the second chamber in a radial direction and that are oriented, with respect to the horizontal axis, respectively of angles α and δ comprised between 30° and 150°.

EXAMPLES

The examples carried out envisage values of the operative and structural parameters lying within the ranges indicated in the following tables.

Tables 1, 2, 3 and 4 respectively show the main geometrical parameters of the reactor according to the invention utilised in the examples, the flows inlet to the reactor, the operating parameters and the flows outlet from the reactor.

TABLE 1

Main geometrical parameters of apparatus

| | Unit of measure | Variability range | Example value |
|---|---|---|---|
| l/d ratio | | 1 ÷ 5 | 2.75 |
| L/D ratio | | 1 ÷ 5 | 2.3 |
| D/d ratio | | 0.5 ÷ 2 | 1.5 |
| Angle α | degrees | 30° ÷ 150° | 80° |
| Angle δ | degrees | 30° ÷ 150° | 80° |

TABLE 2

Flows inlet to reactor

| | Unit of measure | Variability range | Example value |
|---|---|---|---|
| Size of material | mm | 1 ÷ 40 | <5 |
| Total flow rate of materials | kg/h | 100 ÷ 10000 | 2000 |
| Materials flow rate-first chamber | kg/h | 25 ÷ 2500 | 500 |
| Materials flow rate-second chamber | kg/h | 75 ÷ 7500 | 1500 |
| Air flow rate-first chamber | $Nm^3/h$ | 100 ÷ 10000 | 600 |
| Air flow rate-second chamber | $Nm^3/h$ | 100 ÷ 10000 | 900 |

TABLE 3

Operating parameters

| | Unit of measure | Variability range | Example value |
|---|---|---|---|
| Process temperature-first chamber | ° C. | 350 ÷ 950 | 800 |
| Process temperature-second chamber | ° C. | 350 ÷ 700 | 550 |
| Pressure inside reactor | mm $H_2O$ | −20 ÷ 20 | −5 |
| Stay time-first chamber | min | 10 ÷ 60 | 30 |
| Stay time-second chamber | min | 10 ÷ 60 | 30 |

TABLE 4

Flows outlet from reactor

| | Unit of measure | Variability range | Example value |
|---|---|---|---|
| Fumes flow rate | $Nm^3/h$ | 100 ÷ 10000 | 1700 |
| Material (w/o volatile compounds) flow rate | kg/h | 75 ÷ 7500 | 1500 |

The invention claimed is:

1. A process for removing the volatile components of the fine fraction coming from the separation of the residue from the crushing of vehicles and iron-containing scraps, comprising the following steps, carried out in a rotary-drum reactor having two cylindrical chambers with overlapping bases, initially preheated at temperatures comprised between 500 and 800° C. and 400 and 600° C., respectively:

feeding said fine fraction into the first chamber;

injecting and distributing into the first chamber a combustion supporter, by at least two radial nozzles arranged on a pipe coaxial to the first chamber, with partial combustion of the fine fraction, consequent partial removal of the volatile substances present therein and holding of the temperature of 500-800° C.;

transferring the hot fine fraction, partially stripped of the volatile substances present therein, from the first to the second chamber by a duct apt to foster the attainment in the first chamber of the stay times needed for partial volatilization;

feeding into the second chamber other fine fraction, which mixes to that already treated in the first chamber;

injecting and distributing into the second chamber other combustion supporter, by at least two nozzles arranged on a pipe coaxial to the second chamber, with total removal of the volatile substances present in the fine fraction to be treated and holding of the temperature of 400-600° C.;

collecting the fine fraction free from the volatile components.

2. The process according to claim 1, wherein the second chamber is greater than the first chamber, both in length and diameter.

3. The process according to claim 2, wherein the first chamber and the second chamber are coaxial therebetween.

4. The process according to claim 1, wherein the duct for transferring the hot fine fraction from the first to the second chamber has a progressively decreasing cross section.

5. A reactor suitable for removing the volatile components of the fine fraction coming from the separation of the residue from the crushing of vehicles and iron-containing scraps, comprising the following parts:

a first chamber substantially cylindrical and rotating about its own axis, containing a burner thereinside and equipped with means for feeding the fine fraction and means for injecting the combustion supporter from a pipe coaxial thereto;

a second chamber, substantially cylindrical and rotating about its own axis, and equipped with means for feeding the fine fraction and means for injecting the combustion supporter from a pipe coaxial thereto, the first chamber and the second chamber being equipped with means for mixing the fine fraction and the combustion supporter, and being connected therebetween by a duct.

6. The reactor according to claim 5, wherein the second chamber is greater than the first chamber both in length and diameter.

7. The reactor according to claim 6, wherein the first chamber and the second chamber are coaxial therebetween.

8. The reactor according to claim 5, wherein the means for feeding the fine fraction respectively to the first chamber and to the second chamber, consist in an auger.

9. The reactor according to claim 5, wherein the means for inletting the combustion supporter, respectively into the first chamber and into the second chamber, consist in nozzles obtained into the coaxial pipes, respectively.

10. The reactor according to claim 9, wherein the nozzles obtained into the coaxial pipes are oriented with respect to the horizontal axis of an angle comprised between 30 and 150°.

11. The reactor according to claim 5, wherein the duct for connecting the first chamber and the second chamber is frustoconical-shaped with a progressively decreasing cross section.

12. The reactor according to claim 5, wherein the means for mixing the fraction and the combustion supporter in the first chamber and in the second chamber consist in vanes located inside of the two chambers.

* * * * *

UNITED STATES PATENT AND TRADEMARK OFFICE

CERTIFICATE OF CORRECTION

PATENT NO. : 8,517,724 B2
APPLICATION NO. : 12/599453
DATED : August 27, 2013
INVENTOR(S) : Faslivi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 913 days.

Signed and Sealed this
Fifteenth Day of September, 2015

Michelle K. Lee

Michelle K. Lee
*Director of the United States Patent and Trademark Office*